US008601909B2

(12) United States Patent
Gelormino

(10) Patent No.: US 8,601,909 B2
(45) Date of Patent: Dec. 10, 2013

(54) DECK TOOL

(76) Inventor: Mark L. Gelormino, Harwinton, CT (US)

( * ) Notice: Subject to any disclaimer, the term of this patent is extended or adjusted under 35 U.S.C. 154(b) by 501 days.

(21) Appl. No.: 12/900,107

(22) Filed: Oct. 7, 2010

(65) Prior Publication Data

US 2012/0085065 A1 Apr. 12, 2012

(51) Int. Cl.
*B25C 3/00* (2006.01)
*E04F 15/00* (2006.01)
*B66F 3/00* (2006.01)

(52) U.S. Cl.
USPC ..... 81/46; 81/44

(58) Field of Classification Search
USPC ..... 81/44, 46; 254/11, 15, 16
See application file for complete search history.

(56) References Cited

U.S. PATENT DOCUMENTS 559,052 A * 4/1896 Bennett ..... 254/16
2007/0029536 A1* 2/2007 Goode et al. ..... 256/65.01

* cited by examiner

*Primary Examiner* — Monica Carter
*Assistant Examiner* — Danny Hong
(74) *Attorney, Agent, or Firm* — McCormick, Paulding & Huber LLP

(57) ABSTRACT

A tool for assembling deck boards of a decking structure that uses pronged fasteners to secure the deck boards thereto, the pronged fasteners establishing an at least ⅛" gap between adjacent deck boards. The tool compresses an unsecured deck board into engagement with a set of pronged fasteners that are attached to an exposed edge of an installed deck board.

The tool has a stationary jaw and a moveable jaw supported for movement relative to one another by a frame. Each jaw has a depending lip disposed on an outer edge thereof that is configured to engage one of the deck boards. The tool also has an actuating mechanism that moves the moveable jaw relative to the stationary jaw. The actuating mechanism is, preferably, manually powered, hydraulically powered, or screw driven.

13 Claims, 9 Drawing Sheets

DECK TOOL

FIELD OF THE INVENTION

The present invention generally relates to an apparatus and its use for assembling deck boards on an underlying support of a decking structure and, more specifically, to a tool for installing adjacent deck boards in a decking structure that uses pronged fasteners to secure the deck boards thereto.

CROSS REFERENCE TO RELATED PATENT DOCUMENTS

The present application incorporates the following patents by reference:

U.S. Pat. No. 6,416,269 to Martel et al., entitled "Fastener for securing decking boards to an underlying supporting member"; and U.S. Pat. No. 7,398,623 to Martel et al., entitled "Deck board fastener with concave prongs".

BACKGROUND OF THE INVENTION

Modern decking structures have little in common with decking structures of a few decades ago. Rather than using wood boards, modern decking structures often use hard, high-density, springy synthetic boards made of composite and polymeric materials. The synthetic boards improve the longevity, durability and strength of the decking structure, while also reducing the need to maintain or paint the decking structure.

In addition, rather than using nails and screws to hold all aspects of the structure together, modern decking structures often rely upon fasteners. Some fasteners are designed for use with a support structure that underlies the deck boards, other fasteners facilitate and expedite the installation of deck boards to the base, and still other fasteners are designed for use in both contexts.

However, as the decking structure has changed, the utility of conventional tools, such as a hammer, rubber mallet, screw driver and power drill, has decreased.

As is known in the art, a decking structure has a base, including a number of joists and ledger boards, which defines an upper surface. Deck boards are attached to the base in an adjacent, side-by-side, spaced-apart manner across the upper surface thereof. The deck boards are attached to the joists and the ledger boards via fasteners, such as the pronged hidden fasteners described in U.S. Pat. Nos. 6,416,269 and 7,398,623. In particular, the pronged fasteners are attached to an exposed edge of an installed deck plank and secured to the underlying joist or ledger board. Then, an unsecured deck board is placed adjacent to the installed deck board and driven into place alongside the installed deck board. Specifically, a force is applied, often using a sledge hammer or a soft faced or dead blow mallet, to an outer edge of the unsecured deck board so that an inward edge of the unsecured deck board (i.e., the edge that faces the exposed edge of the installed deck board) is pressed into engagement with the pronged fasteners.

The process of hammering the unsecured deck board into engagement with the pronged fasteners is physically demanding and produces irregular results. In particular, the hammering action jostles the decking structure, which can weaken the connection of the pronged fasteners to the installed deck board and the underlying support. The hammering action potentially damages the deck boards or the pronged fasteners and results in jarring of the boards to such an extent that a secured insertion of the pronged fastener into the opposite edge of the unsecured deck board is not attained. This last issue results in enlarged penetrating holes in the deck board where the prongs should firmly penetrate.

The object of the present invention is, therefore, to provide a tool, which, among other desirable attributes, significantly reduces or overcomes the deficiencies of installation using conventional tools.

SUMMARY OF THE INVENTION

Accordingly, the present invention provides a tool for installing deck boards in a decking structure that uses pronged deck fasteners to secure the deck boards.

In one aspect of the present invention, a tool is provided for installing deck boards in a decking structure that uses pronged fasteners between the adjacent side edges of the deck boards to space the deck boards uniformly apart and connect the deck boards one to another, the tool comprising: a first jaw having a bottom surface for resting upon one deck board, and having a depending lip for engaging one edge of the one deck board; a second jaw having a bottom surface for engaging the upper surface of another deck board, and having a depending lip for engaging an opposite edge of the another deck board, the bottom jaw surfaces of the jaws residing in a common plane; and a frame supporting the jaws and defining a movement path of the second jaw relative to the first jaw in the common plane, the frame including an actuating mechanism for so moving the second jaw whereby the pronged fasteners penetrate the deck board achieving uniform spacing therebetween.

In another aspect of the present invention, a method is provided for securing a unsecured deck board to an installed deck board that is attached to an underlying support of a decking structure using at least one pronged fastener, comprising: providing a tool in a straddling relationship over the unsecured deck board and the installed deck board, the tool engaging an edge of the unsecured deck board and an opposing edge of the installed deck board; and applying a compressive force to the edge of the unsecured deck board and the opposing edge of the installed deck board using the tool; whereby the unsecured deck board is driven toward the installed deck board and the at least one pronged fastener penetrates the unsecured deck board achieving uniform spacing between the unsecured deck board and the installed deck board.

It is an object of the present invention to provide tools of several varieties that allow for hydraulic actuation, jack screw driven by an electric motor or manual operation.

In the case of a tool having a manual actuating mechanism, the manual actuating mechanism has a handle and draw bars that are pivotally mounted to the moveable jaw and the stationary jaw to provide a mechanical advantage.

In the case of a tool with a hydraulic actuating mechanism, the hydraulic actuating mechanism has a linear fluid actuator fixedly mounted to a remote side of the moveable jaw relative to the stationary jaw. The linear fluid actuator is connected via a hose or tube to a source of fluid, such as a hydraulic hand pump, such that activation of the hydraulic actuating mechanism actuates the linear fluid actuator that moves the moveable jaw relative to the stationary jaw. The tool also has a return spring that is mounted in parallel to the linear fluid actuator to return the linear fluid actuator and, thus, the moveable jaw to a resting position when the hydraulic actuating mechanism is deactivated.

In the case of a tool with a screw driven actuating mechanism, the screw driven actuating mechanism includes a thrust bearing mounted to a remote side of the moveable jaw from the stationary jaw, a screw disposed in register with the thrust bearing, a nut mounted to the screw and fixed to the frame, and a drive source of rotary power that mechanically engages the screw. Activation of the drive source rotates the screw within the nut, which moves the moveable jaw relative to the stationary jaw.

In an aspect of the present invention, the tool includes a gripping-handle for facilitating use and alignment of the tool.

It is an object of the present invention to provide an actuating mechanism having an adjustable: stroke, force and rate of movement.

In an aspect of the present invention, the tool includes a biasing mechanism biases the tool into a resting position.

In an aspect of the present invention, the tool includes a retention mechanism that locks the tool in a current position.

It is an object of the present invention to provide an actuating mechanism that exerts a smooth clamping pressure to prevent jarring of the decking structure, damage to the decking structure or loosening of fasteners from the decking boards.

These and other features of the present invention are described with reference to the drawings of preferred embodiments of my invention.

DETAILED DESCRIPTION OF THE FIRST PREFERRED EMBODIMENT

Figure 1:
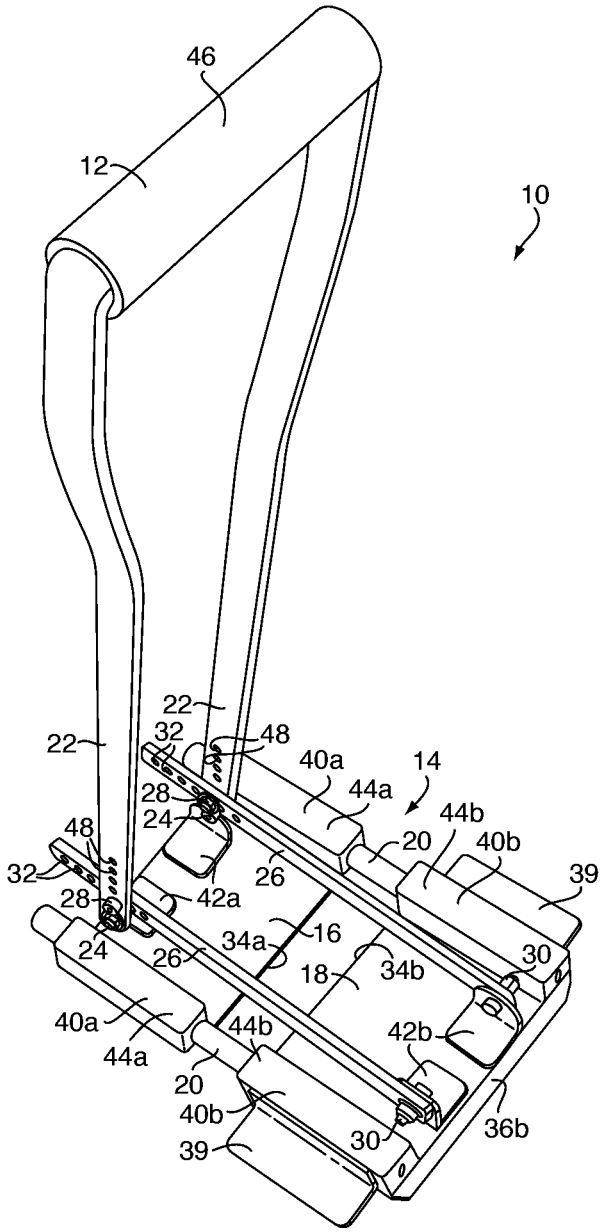
FIG. 1 is a perspective of a first preferred embodiment of my tool.
Figure 2:
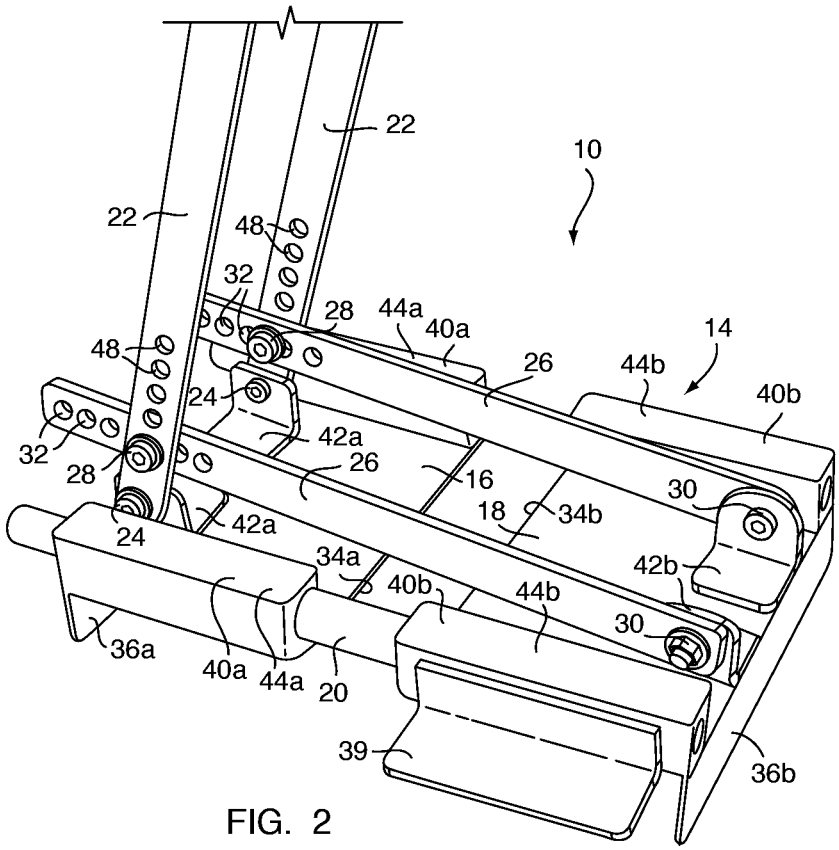
FIG. 2 is a more detailed perspective view of the first preferred embodiment of the tool in FIG. 1.
Figure 3:
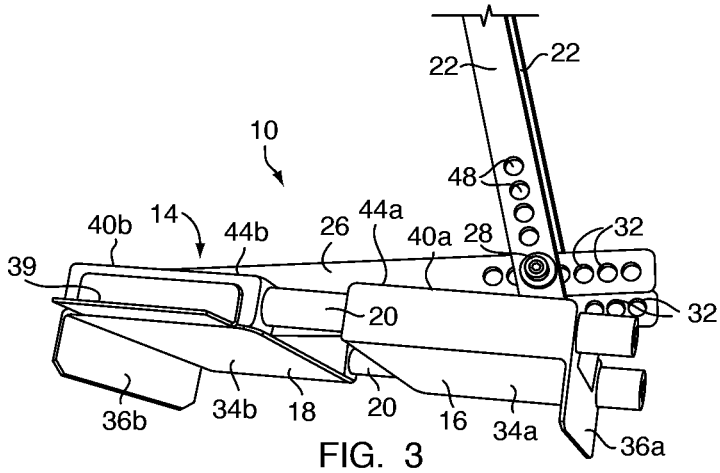
FIG. 3 is bottom perspective view of the first preferred embodiment of the tool in FIG. 1.

Referring to FIGS. 1-3, a tool 10 is shown. The tool 10 has a handle 12 oriented generally normally to a generally horizontally oriented frame 14. The handle 12, which is a manual actuating mechanism of the tool 10 and a gripping-handle to be manipulated by a user, has an inverted U-shape and the lower ends thereof serve as components of a mechanical linkage for moving at least one of two deck board jaws 16, 18, toward and away from one another. More particularly, the frame 14 has at least one, and preferably two, guide tubes, bars or rails 20, 20 (hereinafter "guide rails") that define a horizontal plan, or path of movement for a first moveable jaw 16 relative to a second stationary jaw 18. The fixed jaw 18 is part of the frame 14, and is joined to the ends of the guide rails 20, 20 as described below.

The mechanical linkage includes lower end portions of the handle 12 defining a first pair of levers 22, 22, each of which first levers 22, 22 is pivotally connected to the moveable jaw 16 by a metal bar, screw or pivot pin 24, 24 (hereinafter "pivot pin"), as best shown in FIG. 1. This mechanical linkage further includes second levers 26, 26, such as draw bars, having free ends thereof pivotally connected to selected locations on the lower ends of the first levers, preferably by metal bars, screws or draw pins 28, 28 (hereinafter "draw pins"). Opposite ends of the second levers 26, 26 are pivotally mounted on the stationary jaw 18, preferably by metal bars, screws or pivot pins 30, 30 (hereinafter "pivot pins"), and hence on the frame 14. The plurality of pivot openings 32 at the free ends of the second levers 26, 26 provide a way to reposition the upright handle 12 so the tool 10 can accommodate various width deck boards between jaws 16 and 18.

Figure 5:
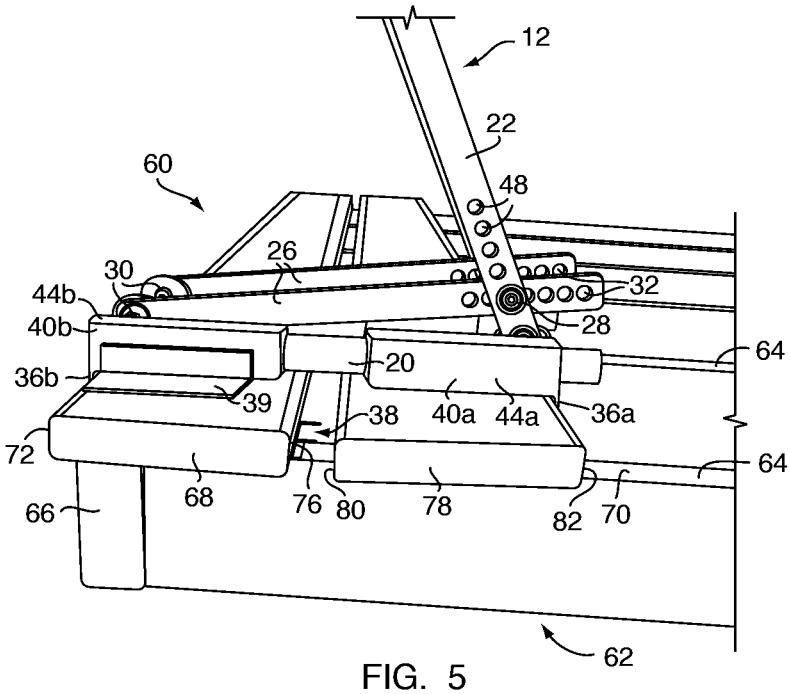
FIG. 5 shows the tool of FIGS. 1-3 in position for use in clamping the deck boards to one another.
Figure 6:
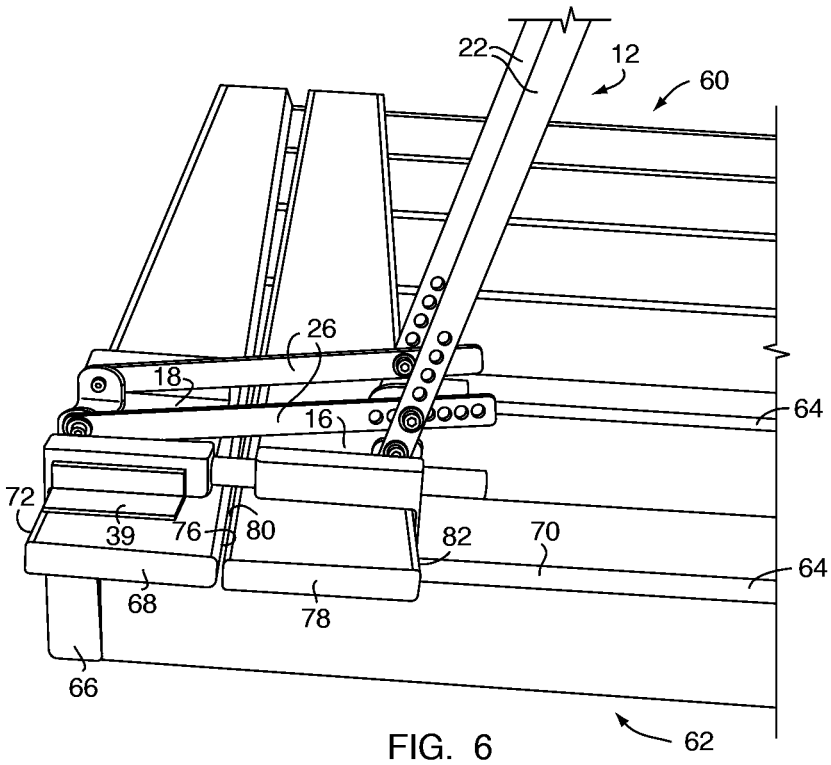
FIG. 6 shows the tool of FIGS. 1-3 clamping the deck boards of FIG. 5.

These jaws 16, 18 have flat planar bottom surfaces 34*a*, 34*b*, respectively, for engaging the upper surfaces of deck boards (see FIGS. 5-6).

Figure 4A:
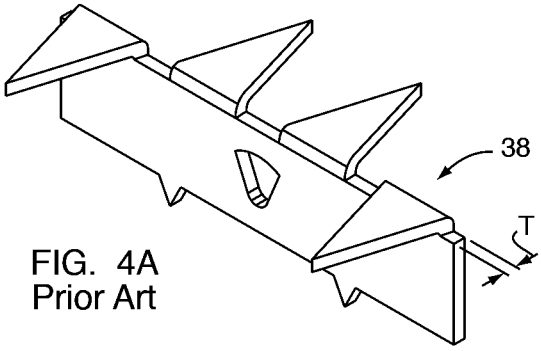
FIG. 4A Prior Art
FIG. 4A is a perspective view of a prior art fastener having prongs for driving into the edges of adjacent deck boards with my tool.
Figure 4B:
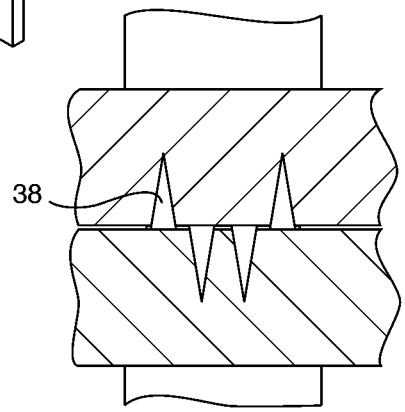
FIG. 4B Prior Art
FIG. 4B shows the fastener of FIG. 4A in horizontal section, after the adjacent deck boards have been clamped together by use of my tool.

As best shown in FIG. 3, the jaws 16, 18 also have depending lips 36*a*, 36*b*, respectively. The depending lips 36*a*, 36*b* are shaped for entry between and engagement with the side edges of adjacent deck boards during the clamping of the deck boards and securement thereof to the underlying decking structure by pronged or drive-in fasteners 38 (hereinafter "pronged fasteners"), such as that shown in detail in FIG. 4A-4B. As shown in FIGS. 4A and 4B, the pronged fastener 38 preferably has a thickness T that dictates the spacing between the deck boards and the depending web portion defines a triangular opening for receiving a screw (not shown) to anchor the fastener 38 to a joist in the underlying decking structure. The fastener 38 is made of metal, and has oppositely projecting prongs that penetrate the side edges of the adjacent deck boards by use of my tool 10, in the manner to be described.

Preferably, the bottom surfaces 34*a*, 34*b* and the lips 36*a*, 36*b* are treated with a thin layer of neoprene, padded or cushioned to minimize the chance of scratching deck boards of the decking structure during use of the tool 10.

Each jaw 16, 18 has a substantially rectangular plate body portion with an outer and inner edge as well as sides and bottom surfaces 34*a*, 34*b*, respectively. The bottom surfaces 34*a*, 34*b* of the flat plate body portions lie in a common plane with each other. Each jaw 16, 18 has a depending lip 36*a*, 36*b* disposed along the outer edge of the plate body portions so configured to engage a deck board. The lips 36*a*, 36*b* have a thickness that is smaller than the width as to be inserted between adjacent deck boards, the gap T being established by the pronged fasteners 38. Preferably, the gap T is at least ⅛". The lips 36*a*, 36*b* are chamfered so that the lips 36*a*, 36*b* can be easily inserted into and removed from between adjacent deck boards. The stationary jaw 18 also has laterally projecting ears 39 disposed along the sides of the plate body portion for a user to stand on during actuation of the handle 12. By standing on these ears 39, the user's weight acts to stabilize the tool 10 on the underlying deck boards and maintain contact between the deck boards and the underlying joist, which ensures flush securement of the deck boards to the underlying decking structure. Both jaws 16, 18 also have frame mounts 40*a*, 40*b* and pivot mounts 42*a*, 42*b* disposed on an upper surface thereof.

As shown in FIGS. 1-3, the frame 14 includes at least the pair of guide bars 20, 20 and the frame mounts 40*a*, 40*b* are in the form of two box-shaped pairs of sleeves 44*a*, 44*b* having openings fitted to receive the guide bars 20, 20. These frame mounts 40*b*, 44*b* for the second jaw 18 are fixedly attached to the guide bars 20, whereas the frame mounts 40*a*, 44*a* of the moveable jaw 16 are movably mounted on the guide bars 20. The frame 14 defines a horizontal plane parallel to the bottom surfaces 34*a*, 34*b* of the plate body of each jaw 16, 18 so that the moveable jaw 16 moves horizontally relative to the stationary jaw 18 along a flat, parallel, straight and smooth path.

The handle 12 has a grip 46 at a free end thereof. The grip 46 includes a rotating, cushioned pad that facilitates manipulation by a user.

The handle 12 has pivot openings 48 formed at an intermediate portion that is generally near the end of the handle 12 that is pivotally mounted to the second jaw 18. By connecting the second levers 26, 26 to a different one of the pivot openings 48, the leverage-ratio (i.e., mechanical advantage) of the handle 12 is adjusted. For example, for a handle 12 of fixed length, the pair of the pivot openings 48 of the handle 12 that is closest to the second jaw 18 might correspond to a 20:1 leverage ratio (i.e., for every one pound of force applied to the grip of the handle 12, twenty pounds of force are applied to the moveable jaw 16) and the pair of the pivot openings 48 of the handle 12 closest to the grip 46 might correspond to a 5:1 leverage ratio (i.e., for every one pound of force applied to the grip 46 of the handle 12, five pounds are applied to the moveable jaw 16). It may be desirable to adjust the leverage ratio of the configured tool 10 based on, for instance, the density or toughness of the deck board, the design of the deck fastener and/or the needs of the user.

It should be appreciated that the handle 12 and the second levers 26, 26, can be interchangeably connected to either of the jaws 16, 18.

Preferably, the sliding connections of the guide bars 20, 20 to the sleeves 44*a*, 44*b* and/or the pivot connections of the handle 12 and the second levers 26, 26 to the pivot mounts 42*a*, 42*b* of the jaws 16, 18 and each other each have moderate friction characteristics. The connections can include rubber washers to control the amount of friction exhibited. The friction facilitates safe and convenient handling of the tool 10. For instance, due to the friction, the tool 10 is retained in its current position until a minimum amount of force is applied to the handle 12 or the jaws 16, 18. By being retained in the same position, the tool 10 can be predictably handled, which improves the user experience.

DETAILED DESCRIPTION OF THE USE OF THE FIRST PREFERRED EMBODIMENT

Referring to FIGS. 5-6, a method of using the tool 10 is illustrated. The method is applicable to assemble the deck boards of a decking structure 60. The decking structure 60 has a base 62 that includes joists 64 and ledger boards 66. An installed deck board 68 has been previously attached to an upper surface 70 of the base 62 using nails, screws or fasteners. In particular, an outward edge 72 of the installed deck board 68 has previously been secured to the base 62 and pronged fasteners 38 have been attached to an opposing, exposed edge 76 of the installed deck board 68. Also, an unsecured deck board 78 has been positioned substantially parallel to the installed deck board 68 and in approximately an installed position. An inward edge 80 of the unsecured deck board 78 faces the pronged fasteners 38 that are attached to the exposed edge 76 of the installed deck board 68 and an opposing, outward edge 82 of the unsecured deck board 78 faces away from the installed deck board 68.

The tool 10 is placed in a straddling relationship over the installed deck board 68 and the unsecured deck board 78 so that the lips 36*a*, 36*b* of each jaw 16, 18, extend around the outward edges 72, 82 of each deck board 68, 78, respectively.

With the tool 10 positioned as shown in FIG. 5, the handle 12 is actuated to drive the moveable jaw 16 and the unsecured deck board 78 toward the stationary jaw 18 and the installed deck board 68, respectively. As a result of the movement, prongs of the pronged fasteners 38 penetrate the inward edge 80 of the unsecured deck board 78 and the unsecured deck board 78 is brought into an installed position, as shown in FIG. 6. The user can stand on the foot ears 39 to stabilize the tool 10 and the deck boards 68, 78 during the compression action.

The tool 10 is then slid sideways (or repositioned) down the length of the unsecured deck board 78 and the process is repeated, as needed. By repeating the compression action along the length of the unsecured deck board 78, any partial penetrations of the pronged fasteners 38 into a remote end of the unsecured deck board 78 relative to the tool 10 are completed. In addition, the penetrating holes formed in the board 10 are minimized in size, which maintains the integrity of the decking structure 60.

The tool 10 applies a compressive force against the outward edge 82 of the unsecured deck board 78 and the outward edge 72 of the installed deck board 68 in a slow, smooth and controlled manner to prevent jarring of the decking structure 60, damage to the decking structure 60 or loosening of the pronged fasteners 38 from the deck boards 68, 78.

Then, according to the usage instructions of the pronged fasteners 38, another set of pronged fasteners 38 are installed to an exposed end 82 of the unsecured deck board 78 to secure the deck board 78 in an installed position.

An additional unsecured deck board is positioned on the base 62 of the decking structure 60 next to the last installed deck board. The process is then repeated for each additional unsecured deck board by placing the tool 10 to straddle the last installed deck board and the next unsecured deck board, until the decking structure 60 is complete.

It should be appreciated that either the stationary jaw 18 or the moveable jaw 16 may be placed to straddle the installed deck board 68 and the other jaw may be placed to straddle the unsecured deck board 78.

Referring to FIGS. 7-10, tools having different actuating mechanism are shown.

DETAILED DESCRIPTION OF THE SECOND PREFERRED EMBODIMENT

Figure 7:
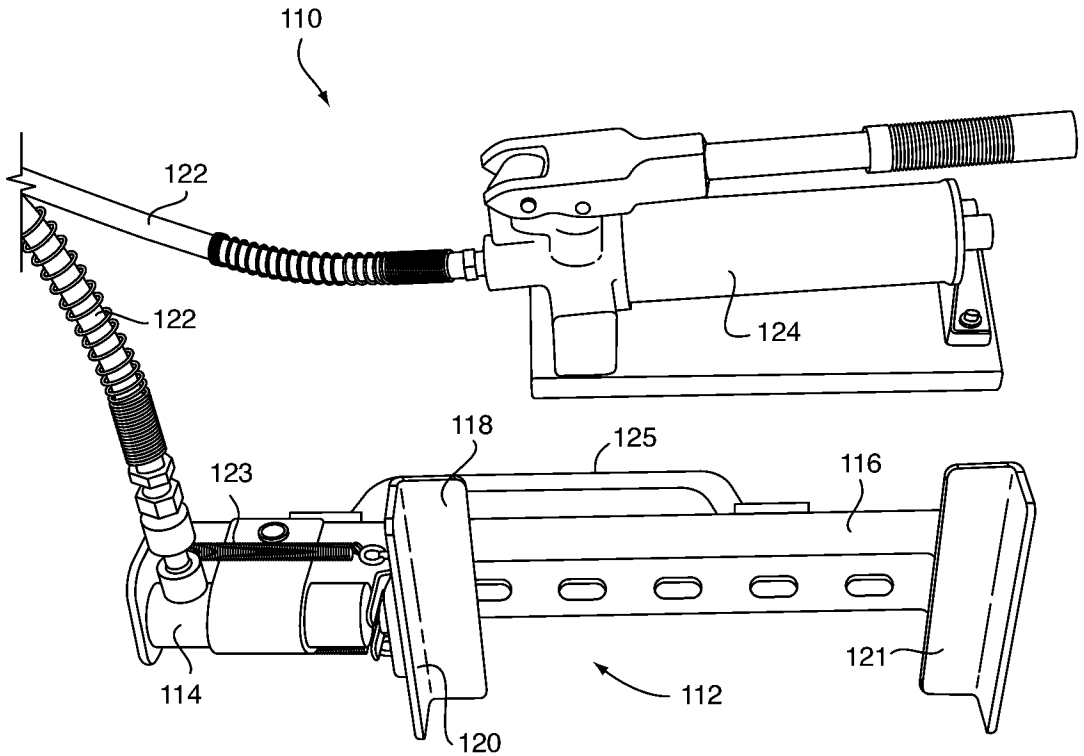
FIG. 7 is a bottom perspective view of a second preferred embodiment of my invention having a fluid actuating mechanism in place of the manually activated lever system shown in FIGS. 1-3.
Figure 8:
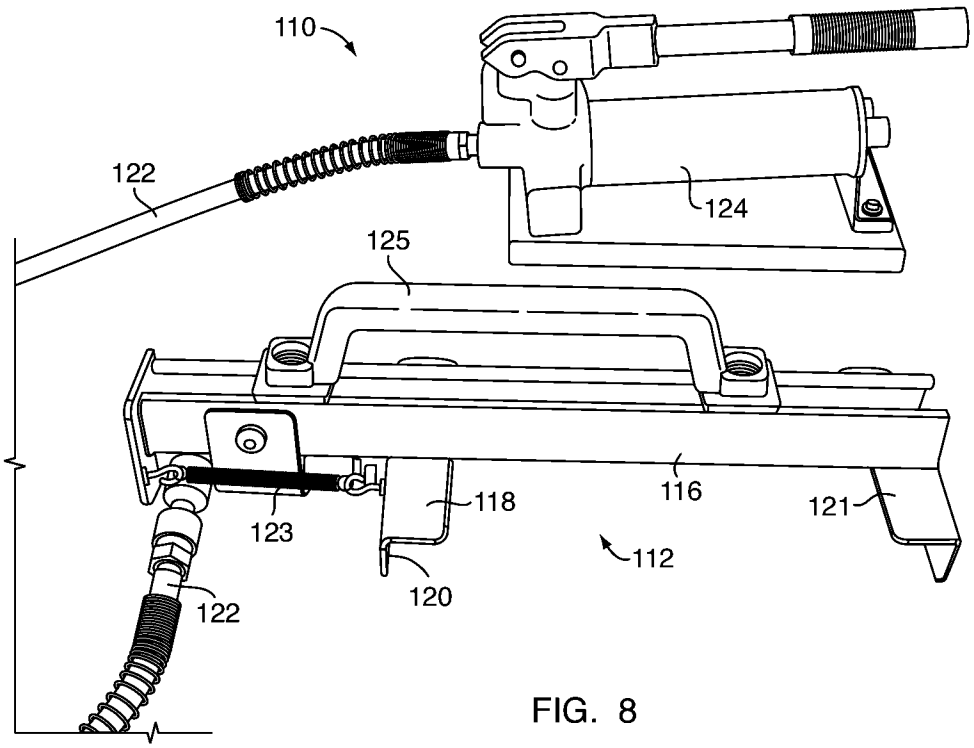
FIG. 8 is a top view of the second preferred embodiment of the tool in FIG. 7.

Referring to FIGS. 7-8, a tool 110 having a hydraulically powered actuating mechanism 112 is shown. The hydraulic actuating mechanism 112 includes a linear fluid actuator 114 having a first portion fixedly mounted to a frame 116 and a second portion mounted to a moveable jaw 118. The linear fluid actuator 114 is adapted to act on the rear of a lip 120 of the moveable jaw 118. The linear fluid actuator 114 is connected via a hydraulic hose 122 or tube to a source of fluid under pressure 124, such as a hydraulic hand pump. When activated, the hydraulic actuating mechanism 112 drives the linear fluid actuator 114 into engagement with the moveable jaw 118 and moves the moveable jaw 118 relative to a stationary jaw 121.

The tool 110 with hydraulic actuating mechanism 112 has return springs 123 that are mounted substantially parallel to the linear fluid actuator 114 to return the first portion of the linear fluid actuator 114 and the moveable jaw 118 to a resting position when the hydraulic actuating mechanism 112 is deactivated. One end of each of the return springs 123 abuts the moveable jaw 118 and the other end of each of the return spring 123 abut the frame 116. Thus, hydraulic pressure is used to hold the jaws 118, 121 in clamping relationship to the two deck boards, and the return springs 123 are used to return the moveable jaw 118 to a resting position.

In the case of the tool 110 with hydraulic actuating mechanism 112, the frame 116 is load bearing and the moveable jaw 118 is slidably mounted thereto.

The tool 110 with hydraulic actuating mechanism 112 also has a gripping-handle 125 fixedly attached to a remote side (i.e., the upper surface) of the frame 116 from the jaws 118, 121. The gripping-handle 125 facilitates the manipulation of the tool 110 and the alignment of the jaws 118, 121 with the decking boards.

DETAILED DESCRIPTION OF THE THIRD PREFERRED EMBODIMENT

Figure 9:
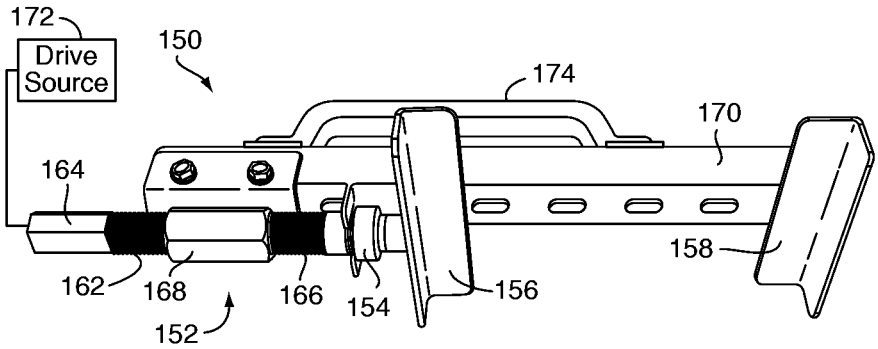
FIG. 9 shows a third preferred embodiment of my invention wherein the fluid actuator of FIGS. 7-8 is replaced with an electrically driven jackscrew.
Figure 10:
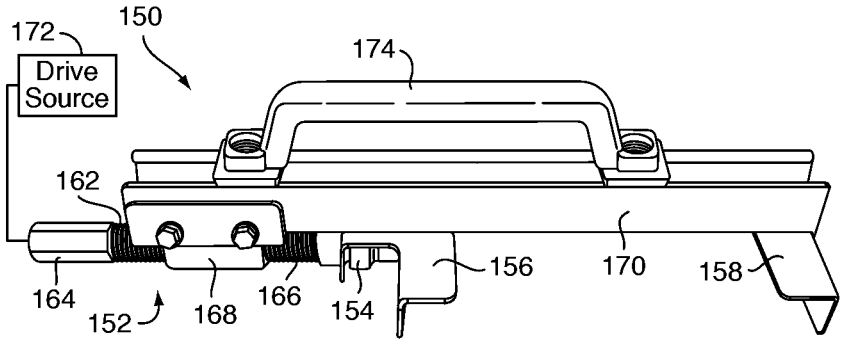
FIG. 10 is a top plan view of the third preferred embodiment of the tool in FIG. 9.

Referring to FIGS. 9-10, a tool 150 with a screw driven actuating mechanism 152 is shown. The screw driven actuating mechanism 152 includes a thrust bearing 154 that is mounted to a remote side of a moveable jaw 156 from a stationary jaw 158. The thrust bearing 154 is mounted to the rear side of a lip 160 of the moveable jaw 156.

A threaded jack screw 162 is disposed in register with the thrust bearing 154 and the moveable jaw 156. One end of the screw 162 is fitted to engage the thrust bearing 154. Preferably, the other end of the screw 162 defines an engageable bit, such as a hex bit 164. The middle of the screw 162 defines a threaded portion, including threads 166.

A threaded screw guide, in the form of a threaded nut 168, is provided on the threads 166 of the screw 162 and is attached to a frame 170 of the tool 150 and hence to the stationary jaw 158. The nut 168 includes threads that correspond to the threads 166 of the screw 162.

A drive source 172 mechanically connects to the hex bit 164 on the screw 162 such that activation of the drive source 172 rotates the screw 162 within the nut 168, which moves the moveable jaw 156 relative to the stationary jaw 158. Preferably, the drive source 172 is a handheld power drill. By equipping the handheld power drill with a matching hex bit, the screw 162 can be quickly and easily engaged and rotated.

In the case of the tool 150 with the screw driven actuating mechanism 152, the frame 170 is load bearing and the moveable jaw 156 is slidably mounted thereto. However, the pitch of the thread on the jack screw 162 and nut 168 are such that slidable movement will be prevented absent activation of the drive source 172, providing a convenient retaining mechanism and locking feature.

The tool 150 with the screw driven actuating mechanism 152 has a gripping-handle 174 fixedly attached to a remote side (i.e., the upper surface) of the frame 170 from the jaws 156, 158. The gripping-handle 174 facilitates the manipulation of the tool 150 and the alignment of the jaws 156, 158 with the decking boards.

The tools 110, 150 with the hydraulic actuating mechanism 112 and the screw driven actuating mechanism 152 are operated according to a substantially similar process as the tool 10 with the handle (i.e., a manual actuating mechanism) 12, as described above in reference to FIGS. 5 and 6. However, rather than actuating the handle 12 to compress the deck boards 68, 78 towards one another, the linear fluid actuator 114 and the screw 162 are actuated, respectively.

DETAILED DESCRIPTION OF THE FOURTH PREFERRED EMBODIMENT

Figure 11:
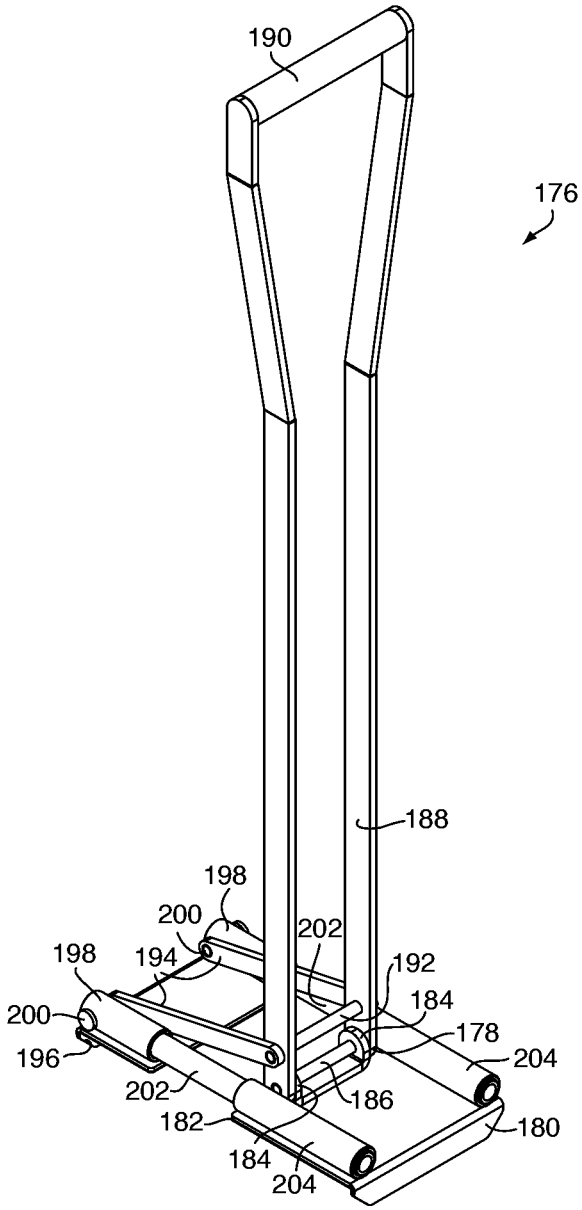
FIG. 11 is a perspective view of a fourth preferred embodiment of my tool.

Referring to FIG. 11, a tool having another manually powered actuating mechanism is shown at 176. The tool 176 has a fixed (i.e., non-adjustable) design that is configured for use with synthetic deck boards of known density and width (e.g., 6").

To balance the tool 176 for use with the known-width synthetic deck boards, a mounting support 178 of a moveable jaw 180 has been positioned on an inner edge 182 of the moveable jaw 180.

The mounting support 178 is a single element having two yokes 184, 184. A metal bar 186 (i.e., an elongated pivot pin) is inserted into the two yokes 184, 184 to pivotally connect a handle 188 to the mounting support 178. The metal bar 186 is welded, establishing a non-adjustable connection between the mounting support 178 and the handle 188.

The handle 188 has a fixed tubular grip 190. The fixed tubular grip 190 is not padded and does not rotate relative to the handle 188. The fixed tubular grip 190 provides a firm surface for a user to engage.

Another metal bar 192 (i.e., an elongated draw pin) pivotally connects the handle 188 to a first end of two draw bars 194, 194. An opposing end of both draw bars 194, 194 is pivotally secured to a stationary jaw 196. In particular, the opposing end of both draw bars 194, 194 is connected to a respective tubular drawn-over-mandrel (DOM) frame mount 198, 198 via pivot pins 200, 200. The pivot pins 200, 200 establish a welded, non-adjustable connection between the draw bars 194, 194 and the frame mounts 198, 198.

Each frame mount 198, 198 slidably receives a first end of a respective tubular DOM guide rail 202, 202. When assembled, the guide rails 202, 202 are securely mounted to the frame mounts 198, 198 via the pivot pins 200, 200. The pivot pins 200, 200, establish a welded, non-adjustable connection between the guide rails 202, 202 and the frame mounts 198, 198.

A second end of each guide rail 202, 202 is slidably received by a respective tubular DOM frame mount 204, 204 of the moveable jaw 180.

The frame mounts 198, 198, 204, 204 are welded along outer lateral edges of the respective jaws 180, 196, the draw bars 194, 194 are pivotally mounted inside of the frame mounts 198, 198 and the handle 188 is mounted inside of the draw bars 194, 194. In this configuration, the handle 188 can be folded flat against the jaws 180, 196, for instance, to facilitate storage or handling of the tool 176 between uses.

It should be understood that the foregoing description is only illustrative of the invention. Various alternatives and modifications can be devised by those skilled in the art without departing from the broader aspects of the present invention.

According to an alternative embodiment of the present invention, the tool is biased into a resting position. Specifically, the moveable jaw can be biased to return to a fixed distance away from the stationary jaw to promote consistent use, which improves the user experience. Biasing the actuating mechanism promotes consistency and predictability of use of the tool, which improves the user experience. For example, in the context of the manual actuating mechanism, the handle can be biased via springs (e.g., mounted to the guide rails and secured to one of the mounting frames at each end thereof) to extend from the moveable jaw at a fixed angle.

Biasing the handle into the resting position (i.e., angle of tilt) corresponds to a fixed distance between the moveable jaw and the stationary jaw. Alternatively, in the context of the hydraulic actuating mechanism, the tool includes return springs, as discussed above. Alternatively, in the context of the screw driven actuating mechanism, the drive source is controlled so as to return the screw to a resting position after completing an actuation.

According to an alternative embodiment of the present invention, the tool includes a retaining mechanism that locks the tool into its current position. For instance, the retaining mechanism engages the moveable jaw to the frame. Alternatively, the retaining mechanism can be integrated into the actuating mechanism. For example, in the case of the manual actuating mechanism, the handle has a latch that locks the handle relative to the second levers (i.e., draw bars) or the moveable jaw to retain the handle in its current position. Alternatively, in the case of the hydraulic actuating mechanism, the linear fluid actuator or the source of fluid under pressure includes a valve that closes to fix the linear fluid actuator in its current position. Alternatively, in the case of the tool with screw driven actuating mechanism, the drive source is locked in place to retain the screw in its current position. The screw is also retained in a current position, at least partially, by the engagement of the screw and the nut, as discussed above.

What is claimed is:

1. A tool for installing deck boards in a decking structure that uses pronged fasteners between the adjacent edges of the deck boards to connect the deck boards one to the other, the tool comprising:

a first jaw having a bottom surface for resting upon a first deck board in spaced and side-by-side relationship with a second deck board, and with a pronged fastener disposed between the adjacent edges of the spaced, side-by-side deck boards, the first jaw also having a depending lip for engaging the edge of the first deck board remote from the adjacent edges of the deck boards;

a second jaw having a bottom surface for engaging the upper surface of the second deck board, and having a depending lip for engaging the edge of the second deck board remote from the adjacent edges of the spaced, side-by-side deck boards, the bottom jaw surfaces of the jaws residing in a common plane; and a frame supporting the jaws and defining a movement path of the first and second jaws relative to one another in the common plane, the frame including an actuating mechanism for moving the first and second jaws toward one another on the movement path and bringing the spaced, side-by-side deck boards together with the pronged fastener between and penetrating the adjacent edges of the first and second deck boards;

wherein the actuating mechanism further comprises a first lever pivotally mounted to the first jaw, and a second lever pivotally mounted to the second jaw, and wherein said levers are pivotally connected to one another such that one of the levers defines a handle moveable manually to bias the jaws toward one another.

2. The tool according to claim 1, wherein the frame further comprises at least one guide rail slidably receiving at least one of the jaws.

3. The tool according to claim 1, wherein:

the frame further comprises:

at least two guide rails oriented parallel to one another along the path of movement for slidably supporting at least one of the jaws; and frame mounts fixedly attached to each respective jaw for receiving the guide rails of the frame.

4. The tool according to claim 3, wherein:

each frame mount further comprises a sleeve fitted to receive the guide rails.

5. The tool according to claim 1, further comprising:

a gripping-handle mounted to at least one of the jaws and/or the frame.

6. The tool according to claim 1, further wherein:

the depending lips of each jaw are rounded to wrap around the remote edges of the first and second deck boards.

7. The tool according to claim 1, further comprising:

a biasing mechanism urging the second jaw toward a resting position relative to the first jaw.

8. The tool according to claim 1, further comprising:

a retaining mechanism for locking the second jaw in a current position.

9. The tool according to claim 1, wherein:

each lever defines at least one pivot opening; and the tool further comprises at least one draw pin inserted into one of the at least one pivot opening of each lever for pivotally connecting the levers to one another.

10. The tool according to claim 9, wherein:

one of the levers defines a plurality of pivot openings such that insertion of the draw pin into a different one of the plurality of pivot openings of the one of the levers varies the maximum spacing of the jaws provided by the frame to accommodate deck boards of various widths.

11. The tool according to claim 10, wherein:

the maximum spacing of the jaws provided by the frame is variable between 6 inches and 30 inches.

12. The tool according to claim 9, wherein:

one of the levers defines a plurality of pivot openings such that insertion of the draw pin into a different one of the plurality of pivot openings of the one of the levers varies the mechanical advantage of the actuating mechanism.

13. The tool according to claim 1, wherein: the handle is substantially U-shaped and has a leg portion pivotally connected to a jaw and a grip portion at a distal end of the handle.

* * * * *